US005241745A

United States Patent [19]

Kippenberg

[11] Patent Number: 5,241,745

[45] Date of Patent: Sep. 7, 1993

[54] PROCESS FOR PRODUCING A CUCB CONTACT MATERIAL FOR VACUUM CONTACTORS

[75] Inventor: Horst Kippenberg, Herzogenaurach, Fed. Rep. of Germany

[73] Assignee: Siemens Aktiengesellschaft, Munich, Fed. Rep. of Germany

[21] Appl. No.: 777,411

[22] PCT Filed: May 31, 1989

[86] PCT No.: PCT/DE89/00344

§ 371 Date: Dec. 2, 1991

§ 102(e) Date: Dec. 2, 1991

[87] PCT Pub. No.: WO90/15425

PCT Pub. Date: Dec. 13, 1990

[51] Int. Cl.[5] ..... H01R 43/16

[52] U.S. Cl. ..... 29/875; 29/874; 75/234; 75/247

[58] Field of Search ..... 29/885, 884, 883, 882, 29/874, 875; 75/247, 234

[56] References Cited

U.S. PATENT DOCUMENTS

| | | | |
|---|---|---|---|
| 3,818,163 | 6/1979 | Robinson . | |
| 4,008,081 | 2/1977 | Hundstad . | |
| 4,032,301 | 6/1977 | Hassler et al. . | |
| 4,190,753 | 2/1980 | Gainer | 200/144 |
| 4,419,551 | 12/1983 | Kato . | |
| 4,687,515 | 8/1987 | Talento | 75/247 X |
| 4,766,274 | 8/1988 | Iyer et al. | 75/247 X |
| 4,780,582 | 10/1988 | Haessler et al. | 200/266 |
| 4,909,841 | 3/1990 | Iyer et al. | 75/234 X |
| 4,954,170 | 9/1990 | Fey et al. | 75/234 X |

FOREIGN PATENT DOCUMENTS

| | | |
|---|---|---|
| 0027893 | 5/1981 | European Pat. Off. . |
| 0172411 | 2/1986 | European Pat. Off. . |
| 0178796 | 4/1986 | . |
| 2521504 | 12/1975 | Fed. Rep. of Germany . |
| 2436927 | 2/1976 | Fed. Rep. of Germany . |
| 2914186 | 10/1979 | Fed. Rep. of Germany . |
| 3406535 | 9/1985 | Fed. Rep. of Germany . |
| 3604861 | 8/1987 | Fed. Rep. of Germany . |
| 1459475 | 12/1976 | United Kingdom . |

OTHER PUBLICATIONS

Siemens Forschungs-Und Entwicklungsberichte, vol. 17, No. 3, Jan. 14, 1988, Berlin, DE, pp. 105-111, R. Müller: Arch-Melted CuCr alloys as contact materials for vacuum interrupters.

Elektrotechnik, No. 11, Nov. 1952, pp. 548-553; F. Eisenkolb: Pulvermetallurgische Werkstoffe der Elektrotechnik (no translation).

*Primary Examiner*—Carl J. Arbes

*Attorney, Agent, or Firm*—Kenyon & Kenyon

[57] ABSTRACT

To produce CuCr contact materials, it is known to use purely powder-metallurgical, sinter impregnation and smelt-metallurgical processes. Only materials produced by smelt-metallurgical processes are suitable as contact materials for vacuum contactors based on copper-chromium. According to the invention, a contact material for vacuum contactors consisting essentially of copper (Cu) and chromium (Cr) in the proportion of 50 to 70% wt. Cu and 30 to 50% wt. Cr is manufactured by pressing and sintering a powdered mixture of the components until a closed porosity is attained and by subsequently cold working the sintered body. It has been possible to demonstrate that an intimate and faultless bonding of the components Cu and Cr is obtained by cold welding the structural constituents with this process as with smelting.

10 Claims, 1 Drawing Sheet

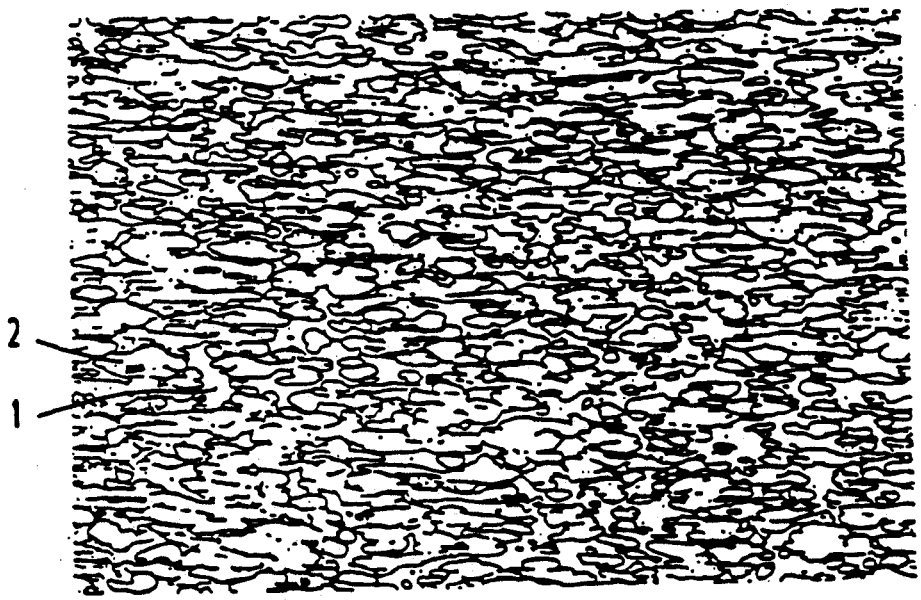
2
1

PROCESS FOR PRODUCING A CUCB CONTACT MATERIAL FOR VACUUM CONTACTORS

BACKGROUND OF THE INVENTION

The present invention relates to a process for producing a contact material for contact pieces of vacuum-contactor tubes essentially consisting of copper and chromium in a proportion of 50 to 70% wt. Cu and 30 to 50% wt. Cr. In addition, the present invention also relates to a contact material produced with the process according to the present invention.

After having gained world-wide acceptance as a leading switch principle for the medium-voltage range, that is approximately in the 7.2 to 40 kV range, the vacuum switch principle is also becoming increasingly significant for contactor applications. Since the development of high-voltage contactors for the voltage range of about 1 to 10 kV, vacuum contactors have also been developed for and applied in the low voltage ranges.

The requirements for vacuum contactors and vacuum medium-voltage circuit-breakers differ fundamentally. Thus, at least 1 million electric operating cycles below nominal current are required of the contactor. Since, in this connection, application cases such as reversing circuit arrangements must be controlled, errors such as electric restrikings, in particular, which can lead to immediate phase-to-phase short circuits, must not be allowed to occur during the breaking operation. In comparison, clearly a lower number of operating cycles is expected of the circuit-breaker, such as 20,000 operating cycles at nominal current. Reversing circuit-arrangements are not customary in the case of circuit-breakers.

As far as the contactor is concerned, currents which are higher by factors than the nominal current must still be able to be reliably switched off and switched on without welding. However, a short-circuit-current breaking capacity is not required as it is of the circuit-breaker, since contactors have line-side fuses.

Corresponding to the diverging requirements for contactor switching properties compared to circuit-breakers, the requirements for the contact material also vary. In vacuum circuit-breakers, contact materials based on CuCr have become generally accepted as the best suited materials. For vacuum contactors, on the other hand, materials such as WCu, MoCu or WCAg—optionally with other additives—are still customary. However, among other things, with a rising number of operating cycles, their switching capacity and dielectric strength deteriorate. In tests to use CuCr materials for contactors as well and to utilize their advantages such as constantly high switching capacity, good gettering capability or high dielectric strength, it turned out that conventionally manufactured CuCr materials—as described for example in the German Published Patent Application 29 14 186, the German Published Patent Application 34 06 535, the German Published Patent Application 25 21 504 or the EP-A-0 178 796—do not fulfill the expectations. With such sintered or sintered impregnation material, problems are caused by the erosion characteristics at a high number of operating cycles. That is, the material loss resulting from erosion exceeds the tolerable limiting values, so that the desired nominal-current number of operating cycles is no longer achieved. Moreover, heavily fissured structures are produced on the switching surfaces. This tends to result in faulty dielectric characteristics in the form of restrikings after current zero.

For the first time, a vacuum contactor with contact pieces of CuCr contact material and a process for producing the contact pieces is specified in the EP-B-0 172 411. According to that process, the contact material is produced by remelting it in the electric arc. The contact material formed possesses a very fine, homogeneous distribution of chromium in the copper matrix and an excellent bonding between both components. Because of these exceptional features, these types of CuCr contact materials exhibit a marked increase in their resistance to erosion. As a result of this increased resistance to erosion, they satisfy the requirements for the vacuum contactor operation and at the same time, the erosion pattern of the contact pieces is uniform thus eliminating the cause of the undesirable restrikings after current zero.

The process of electric-arc remelting can only be applied economically when large-diameter remelting electrodes are used. However, contactors require contact pieces of a relatively small diameter. Thus, the material utilization of the remelted material is comparatively small, which represents a decline in economic efficiency.

Therefore, the object of the present invention is to specify a process with which contact material based on CuCr can likewise be produced for use in vacuum contactors, and to indicate the contact material produced by it.

SUMMARY OF THE INVENTION

This objective is solved according to the process of the present invention comprising the following process steps:

- preparing a powder mixture from powders of the components;
- compressing and sintering the powder mixture until a closed porosity is attained;
- subsequently, cold working the sintered body with a degree of deformation of at least 40% such that a final compression with a space filling of at least 99% is achieved.

A contact material produced according to this process on the basis of copper and chromium is characterized in that chromium particles are embedded in a copper matrix, the chromium particles are welded with the copper surrounding them, and that the chromium particles are stretched rectilinearly in the copper matrix.

Partial features of the present invention are known from prior art. Thus, for example, a process for producing molded components with little residual porosity from a dispersion-hardened, silver-metal-oxide composite powder is described in the DE-A-24 36 927. Here, the composite powder is initially compacted into a blank mold. The blank mold is subsequently hot after-pressed into an intermediate form, and finally the intermediate form is cold pressed. Optionally, there can also be an intermediate sintering step.

The latter process focuses in particular on silver-metal-oxide materials. To apply contact bodies based on the same material by means of ultrasonic welding, in the EP-A-0 027 893 a cold deformation of the material is achieved by means of a punch, whereby the simultaneous ultrasonic effect supposedly causes a welding together with the carrier However, this process is not useful for producing a contact material for contact pieces of vacuum contactor tubes.

On the other hand, the DE-A-36 04 861 describes a process for contact materials formed of copper-chromium, which in particular comprises a hot isostatic pressing operation (HIP). On the other hand, the EP-A-0 178 796 describes the powder-metallurgical manufacturing of contact pieces for vacuum switches of the constitution CuCrBi, whereby initial powders of copper, bismuth and chromium are cold pressed and sintered and subsequently punched into contact pieces. A punching process can in fact effect a deformation of the material. However, due to the unspecified degree of deformation, a welding of the blank that had previously been sintered to a closed porosity is not to be expected.

A closed porosity is generally attained where the CuCr material produced according to the invention has a 92% space filling. Sintered bodies with a small degree of space filling would allow an exchange of gas or air into the inside of the workpiece because of open porosities. Gas or air concentrations introduced in such a way are predominantly occluded in the subsequent cold-working and have a negative effect on the switching properties of the contact piece.

The present invention enables a CuCr material to be produced which is suitable for vacuum contactors and, because of the way it is manufactured, has the advantage of being particularly cost-effective. However, the prerequisite for suitability as a contact matrix, namely the intimate and faultless bonding of the components copper and chromium, is not obtained through a melting operation, but rather by cold welding the structural constituents. For this purpose, one proceeds advantageously from a sintered CuCr powder mixture, which is subsequently cold upset cold compressed into a form. It is significant, in this case, that a degree of deformation of at least 40% is attained during the compression step. During this transformation process, the components copper and chromium undergo a strong deformation. The boundary surfaces between the individual components are broken open and cold welded. The resulting bonding of the two components is so stable that the requirements for using such a material for the contact pieces in the vacuum contactor are well fulfilled.

The material utilization is very high in the process according to the present invention. The volume of the sintered body can advantageously be adapted to that of the upsetting form, and this compression form is designed to have dimensions as close as possible to the end geometry of the contact pieces so all that still needs to be done is to sparingly finish-turn the surfaces. Consequently, one can work very cost-effectively with the described process.

To obtain the needed material hardening by means of cold welding, instead of a compression process, a cold extrusion or milling step can also be selected, whereby a minimum degree of deformation of $\geqq 40\%$ must likewise be adhered to.

BRIEF DESCRIPTION OF THE DRAWING

FIG. 1 illustrates chromium particles embedded in a copper matrix

DETAILED DESCRIPTION

A closed porosity is generally attained in the case of the CuCr material produced according to the invention as of 92% space filling. Sintered bodies with a small degree of space filling would allow an exchange of gas or air into the inside of the workpiece because of open porosities. Such gas and air concentrations have a negative effect on switching properties of the contact piece. Gas or air concentrations introduced in such a way are predominantly removed in the subsequent cold-working process. The present invention produces a CuCr material which is suitable for vacuum contactors. The CuCo may contain additives such as Al, Fe, Mo, Nb, Tn, Ti, W, Zr, Te, Se, Bi, and Sb to improve the contact piece's switching properties. Due to the way it is manufactured, the CuCr material has the advantage of being particularly cost-effective. However, the prerequisite for suitability as a contact matrix, namely the intimate and faultless bonding of the components copper and chromium, is obtained by cold welding and structured constituents and not through a melting operation. For this purpose, one proceeds from a sintered CuCr powder mixture, which is subsequently cold compressed into a form. It is significant, in this case, that a degree of deformation of at least 40% is attained during the compression process. During this transformation process, the components copper and chromium undergo a strong deformation. The boundary surfaces between the individual components are broken up and cold welded. The resulting bonding of the two components is so stable that the requirements for using such a material for the contact pieces in the vacuum contactor are well fulfilled.

The final compression achieved with the process of the present invention lies in any case above 99% space filling.

In this process, material utilization is very high. The volume of the sintered body can be adapted to that of the upsetting form. This compression form is designed to have dimensions as close as possible to the end geometry of the contact pieces, so all that is left to be done is to sparingly finish-turn the surfaces. consequently, the described process is very cost-effective.

To obtain the needed material hardening by means of cold welding, instead of a compression process, a cold extrusion or milling step can also be selected, whereby a minimum degree of deformation of $>40\%$ must likewise be adhered to.

Further details and advantages of the present invention are revealed in the following description of examples, whereby further below, reference is made to a light-microscopic structural pattern.

EXAMPLE 1

Cu powder with particle size distributions of $<63$ um and Cr powder with grain size distributions of $<40$ um are dry mixed in a 60:40 proportion and pressed under a pressure of, for example, 800 MPa into cylinders. The diameter of the cylinders is more or less the same as their height. Blanks are sintered under a high vacuum with a pressure of $p \leqq 10^{-4}$ mbar at about 1050° C. for about three hours, resulting in a space filling degree of about 94%. The sintered body is subsequently upset compressed. The form's diameter is about five times its height. After finish-turning the surfaces, individual disk-shaped contact pieces are produced by cutting them from the bar.

A variant of the above example consists in producing special contours of the contact pieces such as curvatures, bevels and/or depressions directly through the geometry of the compression form, without having to remove material later on.

EXAMPLE 2

Cu powder with particle size distributions<63 um and Cr powder with grain size distributions of<63 um are dry mixed in proportions of 55:45 and isostatically cold pressed at a pressure of about 3000 bar into cylinders of 80 mm diameter. The blanks are then heated under highly purified hydrogen (having a saturation temperature of less than −60° C., to 1000° C.) and then are sintered under a high vacuum with a pressure of $p \leqq 10^{-4}$ mbar at about 1030° C. for about six hours, resulting in a space filling degree of about 95%. The sintered bodies are subsequently deformed by means of full-forward extrusion into bars of 35 mm diameter, whereby the degree of deformation amounts to about 65%. After finish-turning the surface areas, a multitude of contact pieces are obtained by cutting the bar to length into 5 mm high disks.

As illustrated in FIG. 1, it becomes clear from the corresponding structural pattern that chromium particles 2 are embedded in a copper matrix 1. In particular, by deforming the sintered body through compression means, the chromium particles, originally formed unsystematically and partially bonded by means of sinter bridges, are stretched predominantly rectilinearly and thereby cold welded with the copper surrounding them. The good working properties of the contact material for vacuum contactors are attributed to this cold welding.

What is claimed is:

1. A process for producing a contact material for contact pieces of vacuum-contactor tubes essentially comprising copper (Cu) and chromium (Cr) in the proportion 50 to 70% weight Cu and 30 to 50% weight Cr, comprising process steps of:

preparing a powder mixture from powders of the components;

compressing and sintering the powder mixture until a closed porosity is attained;

subsequently, cold working the sintered body with a degree of deformation of at least 40%; such that a final compression with a space filling of at least 99% is achieved.

2. The process according to claim 1, wherein the sintered body is cold worked using means for compressing.

3. The process according to claim 1, wherein a compression form is used having a contour approaching the desired geometry of the contact piece.

4. The process according to claim 1, wherein the powder mixture of the components is pressed into cylindrical molded bodies containing approximately the amount of material needed for a contact piece.

5. The process according to claim 4, wherein the cylindrical molded body is compressed with a pressure of between 400 and 1000 MPa.

6. The process according to claim 1, wherein the sintered bodies are cold deformed by means for extrusion.

7. The process according to claim 1 wherein the powder mixture of the components is isostatically pressed with a pressure of more than 2000 bar into cylindrical molded bodies containing at least twenty times the amount of material needed for a contact piece.

8. The process according to claim 1 wherein the powder mixture is sintered at temperatures below the melting temperature of copper, in particular between 1000° C. and 1070° C., in a high vacuum with a pressure of $p \leqq 10^{-4}$ mbar.

9. The process according to claim 8, wherein the sintering process is at least partially implemented in an environment of highly purified hydrogen.

10. The process according to claim 1, wherein the powder mixture of copper and chromium contains other additives to improve the switching properties of the contact piece, such as aluminum (Al), iron (Fe), molybdenum (Mo), niobium (Nb), tantalum (Ta), titanium (Ti), tungsten (W) zirconium (Zr) and/or tellurium (Te), selenium (Se), bismuth (Bi), antimony (Sb).

* * * * *

UNITED STATES PATENT AND TRADEMARK OFFICE

CERTIFICATE OF CORRECTION

PATENT NO. : 5,241,745
DATED : September 7, 1993
INVENTOR(S) : Kippenberg et al.

It is certified that error appears in the above-indentified patent and that said Letters Patent is hereby corrected as shown below:

On the title page, item

[54] "PROCESS FOR PRODUCING A CUCB CONTACT MATERIAL FOR VACUUM CONTACTORS"

should be

--PROCESS FOR PRODUCING A CUCR CONTACT MATERIAL FOR VACUUM CONTACTORS--.

[56] Other Publications, line 3, "Arch-Melted" should be --Arc-Melted--.

Signed and Sealed this

Twenty-first Day of February, 1995

*Attest:*

*Attesting Officer*

BRUCE LEHMAN

*Commissioner of Patents and Trademarks*